United States Patent [19]

Hooghiemstra

[11] Patent Number: 5,033,642

[45] Date of Patent: Jul. 23, 1991

[54] DIVIDER FOR A GUIDE TRACK FOR BALL-SHAPED OBJECTS

[75] Inventor: George A. Hooghiemstra, Bilthoven, Netherlands

[73] Assignee: Jedaho B.V., Bilthoven, Netherlands

[21] Appl. No.: 461,643

[22] Filed: Jan. 5, 1990

[30] Foreign Application Priority Data

Jan. 10, 1989 [NL] Netherlands ..... 8900051

[51] Int. Cl.[5] ..... B65H 1/00; A63B 57/00

[52] U.S. Cl. ..... 221/68; 273/201

[58] Field of Search ..... 273/201, 11 R, 11 C, 273/26 R, 121 R, 121 D, 121 E, 122 R, 124 R, 125 R, 127 C, 182 R, 182 A; 193/29; 198/359, 442; 221/68, 289, 296, 298, 309

[56] References Cited

U.S. PATENT DOCUMENTS 1,733,394 10/1929 Bible et al. .
2,215,702 9/1940 Holm ..... 198/442
2,752,027 6/1956 Gentry ..... 198/442

FOREIGN PATENT DOCUMENTS 2519958 11/1976 Fed. Rep. of Germany .
1499884 2/1978 United Kingdom .

*Primary Examiner*—Andres Kashnikow
*Assistant Examiner*—Lesley D. Morris
*Attorney, Agent, or Firm*—Young & Thompson

[57] ABSTRACT

A divider for a guide track for ball-shaped objects such as golf balls, is provided with a feed channel and two discharge channels, the feed channel being placed asymmetrically relative to the two discharge channels, in such a way that each arriving ball-shaped object emerging from the feed channel is movable in the direction of one and the same discharge channel and can be accommodated therein until the discharge channel is filled with foregoing objects, following which any subsequently arriving object can be accommodated in the other discharge channel due to the fact that, through colliding with the objects present in the filled discharge channel, the object is then movable in the direction of the other discharge channel.

4 Claims, 2 Drawing Sheets

DIVIDER FOR A GUIDE TRACK FOR BALL-SHAPED OBJECTS

The present invention relates to a divider for a guide track for ball-shaped objects such as gold balls, provided with a feed channel and two discharge channels.

Such a divider is known, for example from EP-A-94267. In the case of this known device the ball-shaped objects are distributed at random over the discharge channels. The channel into which an object will go is thus not known beforehand. If both channels fulfill the same function, for example discharging balls to different storage spaces, this is no problem.

For other applications it is, however, desirable for one of the channels to be filled with objects first, and for the other channel to be filled only when the first one is full. An example of this is the discharge of the objects to a machine for the presentation of the objects, such as a golf practice machine. Here it is desirable for the discharge channel to the gold practice machine to be constantly provided with new golf balls. If, however, too great a number collects in the above-mentioned channel, due to interruptions in the use of the golf balls, they have to be collected in another way, for example in a spare container. They could, however, be recirculated in order to ensure a fresh supply.

The object of the invention is therefore to produce a divider of the type mentioned in the preamble, in which the objects can be fed with priority to one of the discharge channels.

This is achieved according to the invention in that the feed channel is placed asymmetrically relative to the two discharge channels, in such a way that each arriving ball-shaped object emerging from the feed channel is movable in the direction of one and the same discharge channel and can be accommodated therein until said discharge channel is filled with foregoing objects, following which any subsequently arriving object can be accommodated in the other discharge due to the fact that, through colliding with the objects present in the filled discharge channel, said object is then movable in the direction of the other discharge channel. As a result of this positioning of the feed channel and the speed at which the objects emerge from it, it is ensured at all times that the objects go into the same channel with priority. If the speed at which the objects are fed in is high enough here, it is not important what position the divider at right angles relative to the discharge channels assumes relative to the horizontal. At sufficiently high speed the balls "shoot" in the desired direction, without gravity being able to produce any disruptions in the process.

According to a preferred embodiment of the invention, provision is made for the discharge channels to run parallel to each other and the feed channel to run directed at an angle towards the entrance to one of the discharge channels. The feed channel can be fitted in such a way here that its center line lies in the plane of the center lines of the discharge channels. The transition between feed channel and each discharge channel here is relatively uniform. It is, however, also possible to fit the feed channel in such a way that its center line intersects the plane through the center lines of the discharge channels.

Finally, provision can be made between the feed channel, on the one hand, and the discharge channels, on the other, for a space which is approximately the same width as the sum of the widths of the discharge channels.

The presence of this space has a beneficial effect on the functioning of the divider. If this space is not present, or if it is made too narrow, there is a risk of a ball becoming jammed, which causes the channel system to become blocked. This could constitute a problem particularly in the situation in which one channel is full, and the arriving balls have to go into the other channel by means of a collision. This collision process does not always produce the same change of direction, and the said space then offers the possibility of compensating for slight deviations in this respect without any problems.

Finally, it si also possible to connect a number of dividers in series one after the other. If the direction of the divider is always selected in a suitable manner, a large number of discharge channels can always be operated in a specific sequence.

The invention will be explained further with reference to an example of an embodiment.

Figure 1:
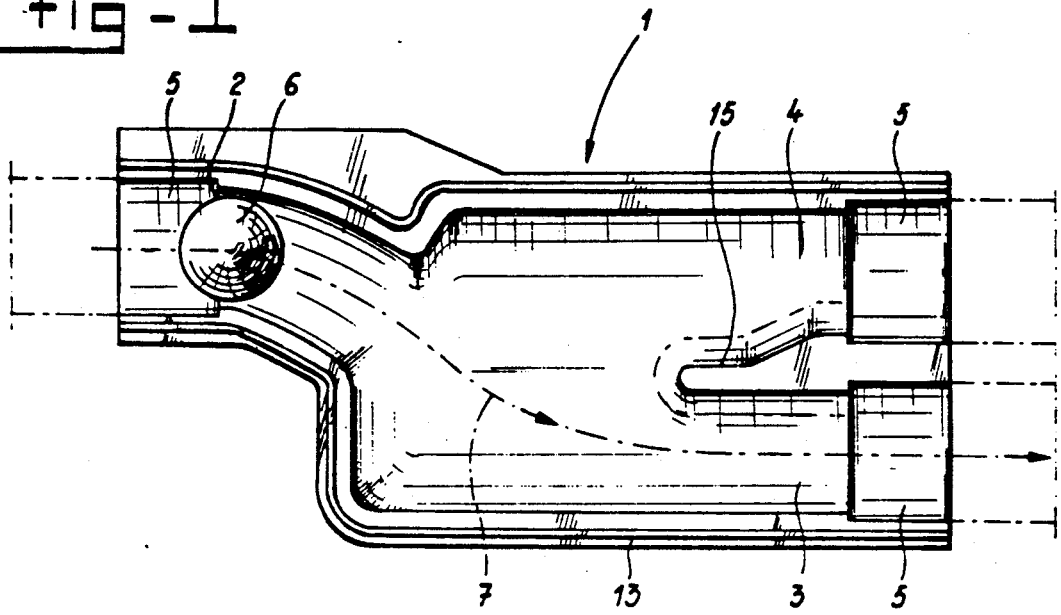
FIG. 1 shows a top view of the bottom half of a horizontally placed divider.

The divider shown in FIG. 1 is provided with a housing 1 with feed channel 2, first discharge channel 3 and second discharge channel 4. The ends of said channels are each provided with a widened part 5 to accommodate connecting pipes (not shown).

The ball 6 rolling into feed channel 2 follows approximately the track 7 which is schematically shown by the dashed and dotted line. As a result of the slanting, asymmetrical positioning of feed channel 2 relative to the discharge channels 3, 4, the ball rolls to channel 3.

Figure 2:
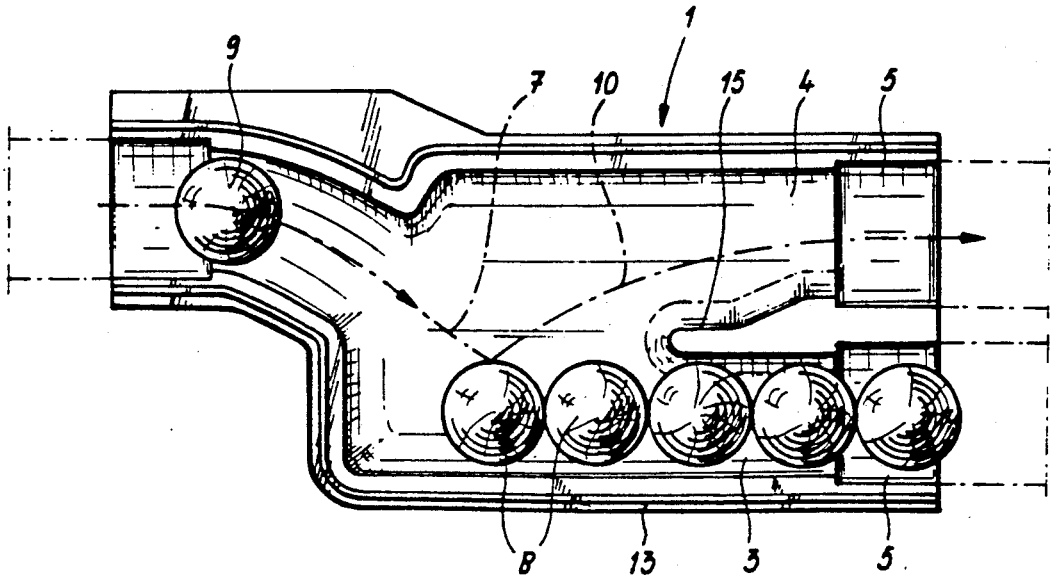
FIG. 2 shows a view corresponding to FIG. 1, in which one channel is filled with balls.

When, as shown in FIG. 2, the channel 3 and the connecting pipe are completely filled with balls 8, ball 9 initially rolls again along track 7. When it hits the front ball 8, its course is changed, and it follows track 10, which means that it goes into discharge channel 4. As shown, the entrance of discharge channel 4 widens due to the fact that the dividing wall has a narrowed front part 15. This reduces the risk of a ball 9 stopping in front of the entrance to discharge channel 4, in particular if the speed of infeed of the balls is low.

Figure 3:
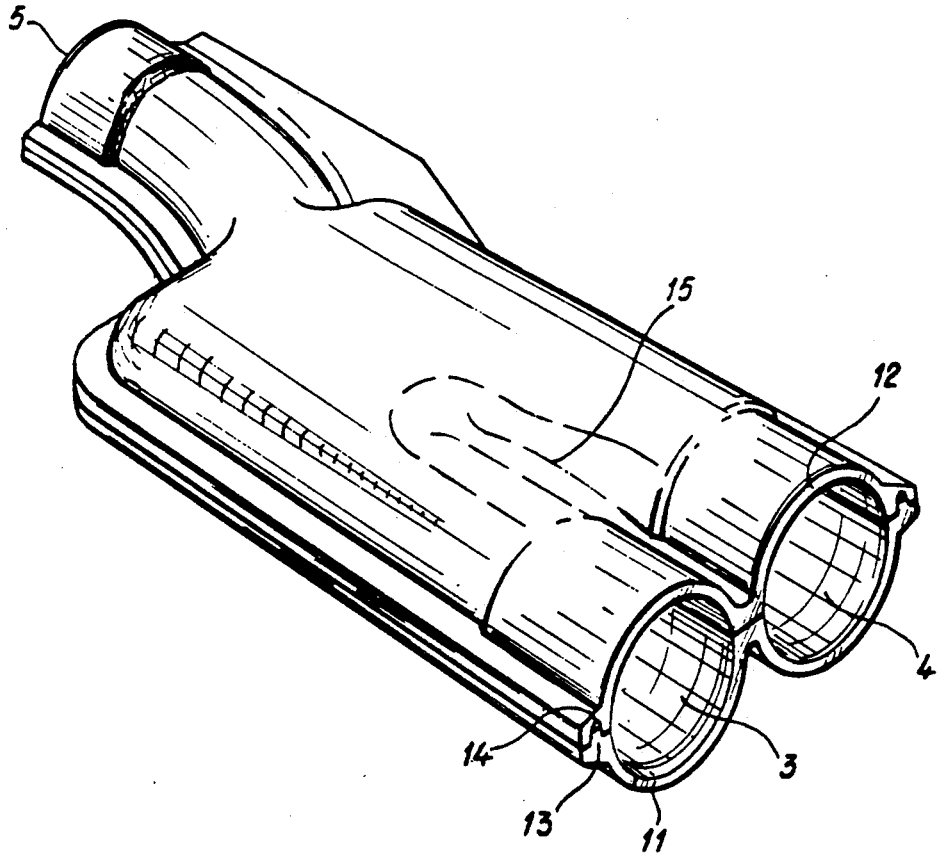
FIG. 3 shows the divider in perspective.

FIG. 3 shown that the divider can be made up of two halves 11, 12 which at their edge are connected by means of a ridge 13 and a groove 14.

FIG. 3 also shows that the channels 2, 3 and 4 are in the form of tubes.

I claim:

1. Divider for a guide track for balls, provided with a feed channel and two discharge channels, wherein the feed channel is placed asymmetrically relatively to the two discharge channels, the channels being shaped as tubes, the feed tube being directed at an angle toward the entrance to one of the discharge tues in such a way that each arriving ball emerging from the feed tube is movable in the direction of said entrance and can be accommodated in the corresponding discharge tube until said corresponding discharge tube is filled with balls, following which any subsequently arriving ball can be accommodated in the other discharge tube due to the fact that, through colliding with the balls present in front of said entrance of the filled discharge tube, said subsequently arriving ball is then movable in the direction of the other discharge tube.

2. Divider according to claim 1, wherein the center lines of all said tubes lie in one plane.

3. Divider according to claim 1, there being a space between the feed tube, on the one hand, and the discharge tubes, on the other, which is approximately the same width as the sum of the widths of the discharge tubes.

4. Distribution device for balls provided with a number of dividers connected in series according to claim 1.

* * * * *